US005156512A

United States Patent [19]

Suzuki et al.

[11] Patent Number: 5,156,512

[45] Date of Patent: Oct. 20, 1992

[54] CARGO HANDLING APPARATUS FOR COLD STORAGE HOLDS OF FISHING VESSELS

[75] Inventors: Kazuo Suzuki, Ibaragi; Tohru Saigyo; Keiji Murase, both of Kanagawa, all of Japan

[73] Assignees: Nippon Suisan Kaisha, Ltd.; Wako Sangyo Co., Ltd., both of Tokyo, Japan

[21] Appl. No.: 580,677

[22] Filed: Sep. 11, 1990

[30] Foreign Application Priority Data

Sep. 19, 1989 [JP] Japan ..... 1-243210

[51] Int. Cl.[5] ..... B63B 27/22; B63B 35/24; B65G 61/60

[52] U.S. Cl. ..... 414/142.1; 198/465.4; 294/74; 294/77; 414/142.6; 414/142.8

[58] Field of Search ..... 198/465.4, 681, 687.1; 294/74, 77; 414/140.8, 142.1, 142.6, 142.7, 142.8, 143.2, 141.7, 137.1, 139.4; 114/72, 255

[56] References Cited

U.S. PATENT DOCUMENTS

| | | | |
|---|---|---|---|
| 2,409,400 | 10/1946 | Telford | 198/681 |
| 3,961,585 | 6/1976 | Brewer | 294/77 X |
| 4,543,035 | 9/1985 | Lair | 414/142.8 X |
| 4,666,356 | 5/1987 | Newbury | 414/143.2 X |
| 4,946,344 | 8/1990 | Prins | 414/139.4 X |

FOREIGN PATENT DOCUMENTS

| | | | |
|---|---|---|---|
| 52-27188 | 3/1977 | Japan | 414/140.8 |
| 1-95990 | 4/1989 | Japan | 114/255 |

*Primary Examiner*—David A. Bucci
*Assistant Examiner*—Janice Krizek
*Attorney, Agent, or Firm*—Sughrue, Mion, Zinn, Macpeak & Seas

[57] ABSTRACT

A cargo handling apparatus for cold storage holds of fishing vessels, comprising a storage station for storing cargo units of fish and shellfish in a frozen or cold state in the vessels and an overhead traveling crane for traveling in the storage station in the longitudinal or transverse direction of the vessel and for conveying an aggregated cargo consisting of one or more cargo units in a state wrapped or bound by a flexible sheet member in the storage station.

12 Claims, 9 Drawing Sheets

CARGO HANDLING APPARATUS FOR COLD STORAGE HOLDS OF FISHING VESSELS

PRIOR ART

Hitherto, fish or shellfish caught using trawlers is transferred and collected into multipurpose reefer vessels. A repeated running of these vessels between the offing and the land enables a transference of the fish or shellfish into the onshore factories, wherein the fish or shellfish is subjected to a prompt processing so as to manufacture fish or shellfish products, i.e., surimi, fish meal or the like.

The offshore transference of fish or shellfish from trawlers or a mother ship to multipurpose reefer vessels necessitates an inherent cumbersome labour of loading or unloading the fish or shellfish, so as to cause frequently a deterioration of the fish or shellfish.

Recently, due to an increase in a distance from the land to the offshore fishery zone there exists a tendency to extend the intervals between the offshore fishing and onshore processing of the fish or shellfish. These intervals can be either several weeks or several months. Consequently, a long transportation of fish or shellfish to the land by use of multipurpose reefer vessels diminishes the quality of the fish or shellfish. The resulting fish or shellfish product produced by the onshore processing has an inferior quality in comparison with that processed immediately after fishing.

Currently, trawlers which maintain fish or shellfish processing equipment, for achieving a prompt processing of fish or shellfish immediately after fishing. The trawler produces surimi (raw fish meat paste) or the like on the ship. The offshore processing product possesses a freshness, taste or the like, each of which is equal substantially to those immediately after fishing.

The offshore processing product is superior in a quality, such as freshness and taste, to the onshore processing product. Consequently, the offshore processing product may sell at a high price.

The surimi of fish or shellfish is usually used as a raw material for food products, such as kamaboko, chikuwa, sausage, or the like. In a process of manufacture of these food products, setting character or the like is required. Between the setting character of onshore processing product and that of the offshore processing products, there exists a great difference. Namely, since the onshore surimi is greatly spoiled in its freshness and quality, high jelly strength can not be obtained even if the surimi is subjected to a process under best conditions. On the other hand, since the offshore surimi possesses a freshness, taste or the like, equal to those immediately after fishing, by using the offshore surimi as a raw material, food products with satisfactory texture, flavoring and taste can be obtained with ease.

In the case, that offshore processing is applied to fish or shellfish immediately after fishing by using fish or shellfish processing equipment, so as to manufacture the offshore processing product, such as offshore surimi. The offshore processing products are transferred from a trawler or the like to a multi-purpose reefer vessel and thence to the land, and these transferences are accompanied together with cargo handling operations, such as loading and unloading of offshore processing product. These cargo handling operations must be carried out in storage holds having limited volumes or spaces. Therefore, these operations are very harsh and highly dangerous.

For example, in the case that offshore processing of fish or shellfish is carried out at a processing station of a trawler, edible portions of fish or shellfish are collected within a period of time ranging from 30 minutes to 2 hours immediately after fishing, and then the resultant edible portions are subjected to kneading processes or the like, thereby producing the offshore surimi. The offshore surimi thus obtained is divided into several units, each of which has a weight suited for being carried by one man, for instance about 20 kg. Each of the units is subjected to packing in a box and then to freezing. The frozen surimi, which is packed with the box, is transported from the processing station to a cold storage hold station adjoining the process station. When the storage station becomes full of the frozen surimi, the frozen surimi accommodated in the storage station of the trawler is transferred to a multi-purpose reefer vessel. This transference takes a considerable time, and is very harsh and requires a very large number of persons.

Each box of frozen surimi, is stored in the storage station of the trawler for several days. To prevent deterioration of frozen surimi, the storage station should be always held at a very low temperature, for instance −30° C., at all time. In the storage station, operations, such as loading frozen surimi, packed with the box, one by one in the storage station of holds of the trawler and transporting the frozen surimi stored at the storage station onto the deck lead to a considerable work. Namely, these operations are carried out in an environment such as a freezer. Therefore, these operations can not be continued for long time due to fatigue of the operator and the crew worker.

Further, the enclosed storage station is sealed with the deck of the trawler, and should be always held at a temperature of about −30° C. However, at the time of transferring the frozen surimi, packed with the box, from the trawler to the multi-purpose reefer vessel, the frozen surimi has to be taken out of the storage station and then transported onto the deck. To this end, the deck is provided with a hatch, through which the cargo of the frozen surimi can be passed. The hatch is desirably as small as possible. It should have an area of at least 60 cm×60 cm, under the consideration of the operation space of the cargo handling equipment on the trawler. However, a cargo handling operation through the hatch with the area of at least 60 cm×60 cm causes a flowing out of a considerable amount of the coldness from the storage station. Further, a transporting operation of frozen surimi or like through the hatch with narrow area onto the deck, by using the cargo handling equipment on the trawler, is not performed with ease and can be carried out only by an operator with considerable skill.

For example, the lifting up of the cargo from the storage station onto the deck is carried out by utilizing a cargo handling crane mounted on the deck of the trawler. Namely, the cargo handling crane has a hook on the lower end thereof. This hook descends into the storage station along through the hatch with a limited area, and hangs several units of frozen surimi packed with the box, and then ascends onto the deck of the trawler. The cargo handling operation using the cargo handling crane necessitates considerable skill of the crane operator, due to the passing of the crane hook, through the hatch with a limited area, while the crane hook descends and the cargo hung by the crane hook ascends.

Effecting a smooth cargo handling operation, Japanese Utility Model application publication No. 30318/1975 describes a cloth made carriage member permitting one to wrap up several units of frozen surimi, packed with the box. This carriage member permits a formation of an aggregated cargo comprising of several unit cases of the frozen surimi. The formation of aggregated cargo, consisting of several units of the frozen surimi by using the carriage member, enables an efficient cargo handling operation between the storage station and the deck of the trawler.

However, the cargo handling operation using the cloth made carriage member necessitates the aggregated cargo to pass through the hatch with limited area and a loading of the cloth made carriage member with the aggregated cargo comprising several units of frozen surimi or the like in the storage station always held at a temperature of approximately −30° C.

A trawler has been proposed to include a sealed storage station with its ceiling portion provided with an overhead traveling crane to handle the cargo, such as frozen surimi or the like, from its storage position to a position right underneath the hatch, in the storage station of trawler holds. With a provision of the ceiling portion of the storage station with the overhead traveling crane, the traveling space of the crane eliminates a storage space permitting to accommodate the cargo, such as frozen surimi or the like, resulted in a great dead space in the storage station. Particularly, with the storage station with a limited space, the reduction of storage space leads to great reduction of the capacity of the trawler.

Additionally, if the storage station is filled with fish or shellfish, fishing is forced to be abandoned in the middle of fishery period. This sacrifices the fishing vessel's productivity.

The foregoing description has mainly concerned the trawler. There are similar problems when the cargo is transferred from the carrier vessel to the land. Similar problems are also encountered with frozen fish and shellfish processed on vessel or ship in addition to offshore processing surimi. Further, when loading cargo from the carrier vessel to land, time delay during anchoring the carrier vessel is inevitable and increases the anchorage expenses, thus greatly increasing the cost of the surimi or other processed products.

SUMMARY OF THE INVENTION

According to the invention, there is provided a cargo handling apparatus for cold storage holds of fishing vessels comprising a storage station for storing cargo units or fish or shellfish in a frozen or cold state in the vessels and an overhead traveling crane for traveling in the storage station in the longitudinal or transverse direction of the vessels and for conveying cargo consisting of one or more cargo units in a state suspended by flexible sheet member in the storage station. The apparatus has an auxiliary carriage member detachably mounted in part of the flexible sheet member and engaged with hook of the overhead traveling crane. A traverse conveying track is provided such that it extends across a traveling path, along which the overhead traveling crane travels towards the longitudinal direction of the vessels, and along which the aggregated cargo is conveyed in a suspended state via the auxiliary carriage member and the flexible sheet member.

A vertical conveying track with a lower end portion disposed adjacent to a leading end of the traverse conveying track and an upper end portion extending up to the deck of the vessels is provided. Therefore, the aggregated cargo transferring from the traverse conveying track can be automatically transported and elevated by the vertical conveying track engaging with the auxiliary carriage member mounted on the flexible sheet member.

In addition, a cargo unit, such as packaged surimi is aggregated by using flexible sheet member, thereby forming and sequently storing the aggregated cargo covered with flexible sheet member, in the storage station. At transferring the aggregated cargo stored in the storage station onto the deck, the auxiliary carriage member is set with one part of the flexible sheet member covering the aggregated cargo to be transferred thereby effecting an automatic transportation and elevation of the aggregated cargo, by traverse and vertical conveying tracks suspending the cargo via the auxiliary carriage member and the flexible sheet member. Thus, even if the storage station is always held at a frozen or cold state, all of the work to be done in the storage station can be automatically effected without any crew worker or operator. Consequently, the crew workers free themselves from suffering with a cargo handling work in the storage station held at a temperature of −30° C.

Further, a waiting station is provided such that it is adjacent to the inlet portion of the traverse conveying track. By this waiting station, the auxiliary carriage member can wait until it reaches and engages with the receiving member of traverse conveying track.

Further, the traverse and vertical conveying tracks are constructed separately. By so doing, it is possible to adjust the levels of the traverse conveying tracks and attain an efficient cargo handling in the storage station.

The upper end portion of the vertical conveying track is bent such that it extends substantially parallel to the deck, and also a conveyor is provided such that it is touched by the bottom of the aggregated cargo suspended by the upper end portion of vertical conveying track. When the aggregated cargo reaches the upper end portion, its bottom is brought into contact with the conveyor, and with this contact the auxiliary carriage member is floated up and can be readily disengaged from the flexible sheet member.

BEST MODE OF CARRYING OUT THE INVENTION

Figure 1:
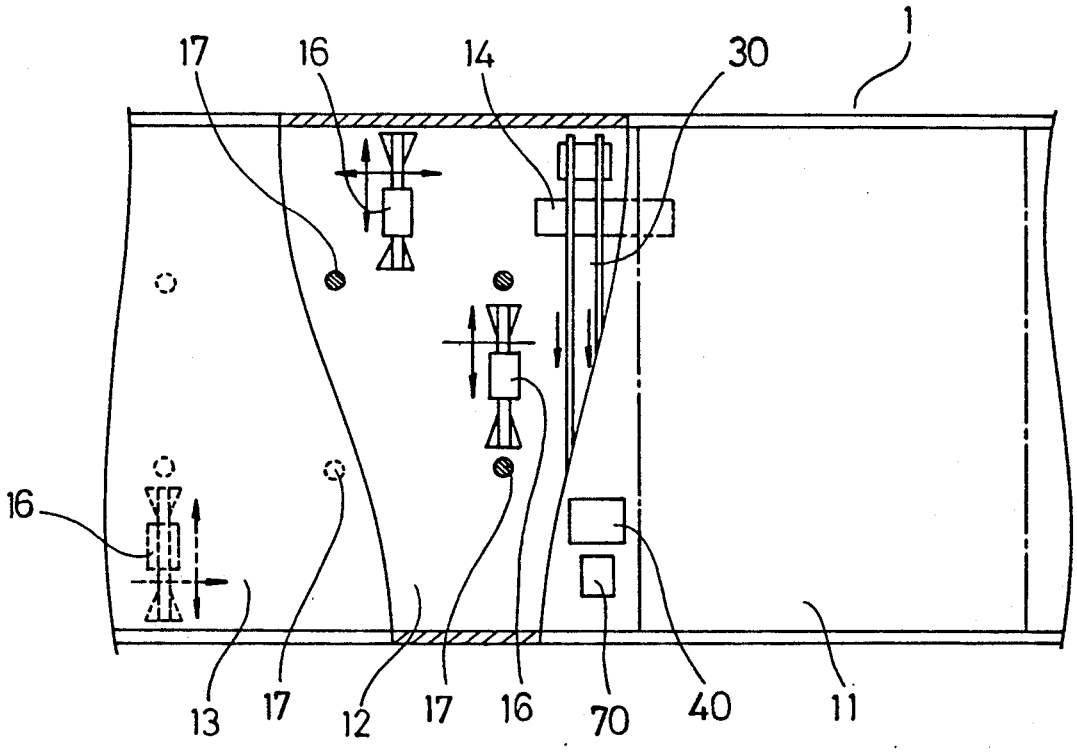
FIG. 1 is a plan view, partly broken away, showing part of a trawler provided with one embodiment of the cargo handling apparatus according to the invention.

Referring to FIG. 1, reference numeral 1 designates a trawler. Trawler 1 is provided with fishing equipment (not shown), processing station 11, in which fish and shellfish are processed immediately after fishing so as to produce a processing product of fish or shellfish, such as surimi or otoshimi (picked meat) and to freeze it, and storage station 12, always held in the frozen or cooled state, for instance at a temperature of about −30° C. Processing station 11 and storage station 12 are provided in holds and closed by deck 13. Storage station 12 should be provided in holds, and it is provided under deck 13. A preservation temperature of storage station 12 varies with the characters of the processing product. In the case of surimi, the station 12 is held at a temperature of about −30° C., and also the station 12 is like a freezer. In processing station 11, fish or shellfish immediately after fishing is are subjected to a prompt processing, so as to produce a processing product of fish or shellfish within a period from 30 minutes to 2 hours. The processing product of fish or shellfish is divided into several units, which has a weight suited for being readily conveyed by only one person, for instance about 20 kg. Each processing product unit is packed in the box or case and then frozen. Each frozen package of processing product is transferred as cargo unit 15 by conveyor 14 connecting with both stations 11 and 12 (see FIGS. 1 and 3) to storage station 12 adjoining the processing station 11. In storage station 12, as many cargo units 15 as possible are loaded to make utmost use of the storage capacity of storage station 12 and leave minimum dead space to be preserved in a frozen state.

For permitting the cargo handling to be carried out with high efficiency and without crew workers or operators, the ceiling of storage station 12 is provided with at least one overhead traveling crane 16. More specifically, storage station 12 is provided in holds of the trawler 1 and is provided with support posts 17 for supporting deck 13. Posts 17 restrict the traveling path of crane 16. Therefore, in the case where conventional overhead traveling cranes are provided, a plurality of, e.g., three in the case of FIG. 1, cranes 16 are provided in correspondence to sections divided by posts 17. In each section, each overhead traveling crane 16 travels in the longitudinal direction and perpendicular direction thereto of storage station 12.

Therefore, even if storage section 12 is divided by posts 17 into a plurality of sections, a single crane provided in a central section of storage station 12 enables an attainment of this end, provided that as the crane is used an overhead traveling crane having a construction to be described hereinunder. This overhead traveling crane has a girder, a shutting beam is provided therebelow, and lifting means is mounted via a slewing unit on an end of the beam. With the crane of this construction, the beam is reciprocated beneath the girder, and end of the beam extends beyond the opposite ends of the girder. Thus, traveling paths in perpendicular directions can be greatly extended. Further, the lifting means can be freely rotated at the beam end via the slewing unit. Thus, it is possible to load cargo without being restricted by the girder mounting position, i.e., up to a position exceeding the girder mounting position.

When handling cargo units 15 conveyed by processing station 11 by traveling of overhead traveling crane 16 in the longitudinal direction and perpendicular direction thereto in the storage station 12, it is not that one or more cargo units 15 are aggregated to obtain aggregated cargo 18 in the neighborhood of the outlet of conveyor 14. The aggregated cargo 18 is wrapped or bound by and together with a flexible sheet member, and thereafter loaded into storage station 12 by the overhead traveling crane 16, thereby resulting in storing the aggregated cargo 18 in a state wrapped or bound with flexible sheet member in storage station 12. Thus, the cargo handling operation enables an aggregative handling of cargo units, an effective utilization of overhead traveling crane 16 and an elimination of danger during the cargo handling.

Figure 6A:
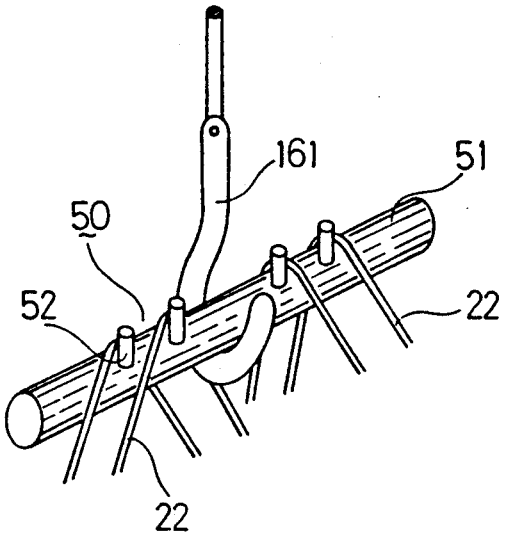
FIGS. 6(*a*) and 6(*b*) are perspective views showing embodiments of the auxiliary carriage member in the cargo handling apparatus according to the invention.
Figure 6B:
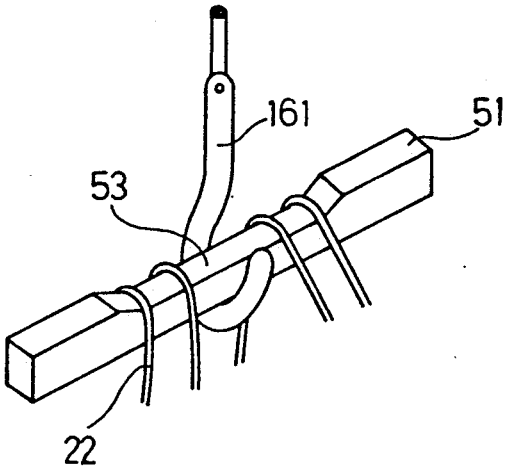

The flexible sheet members 20 can be suspended from crane 16 via auxiliary carriage member 50 shown in FIGS. 6 (*a*) and 6 (*b*).

Flexible sheet member 20 may be of any form so long as it can cover aggregated cargo 18 without causing a separation or collapse thereof.

Figure 3:
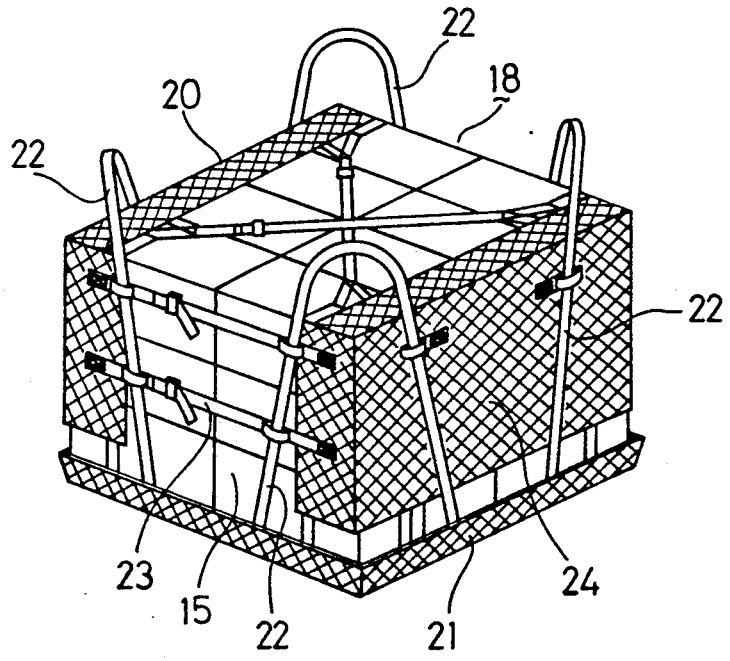
FIG. 3 is a perspective view showing one embodiment of aggregated cargo provided with one embodiment of flexible sheet member according to the invention.

For example, FIG. 3 shows a preferred structure of flexible sheet members 20. It is made of cloth or synthetic resin, preferably synthetic resin.

Flexible sheet members 20 shown in FIG. 3 include plate-like bottom member 21, hanger strips 22 provided at the four corners of bottom member 21, side tightening strips 23 for connecting together hanger strips 22 to prevent a separation or collapse of aggregated cargo 18 and keeping members 24 for keeping aggregated cargo 18 sidewise. With these flexible sheet members 20, cargo units 15 conveyed by conveyor 14 from processing station 11 are transferred one by one on bottom member 21 of flexible sheet members 20 developed in the neighborhood of the outlet of conveyor 14 to aggregate cargo units, resulted in forming the aggregated cargo 18, and then flexible sheet members 20 can be readily mounted by tightly connecting the ends of side tightening strips 23. Thereafter, crane 16 travels in the longitudinal direction or perpendicular direction thereto by means of engaging a part of flexible sheet members 20, i.e., hanger strips 22, with a hook 161 of overhead traveling crane 16 either directly or via auxiliary carriage member 50 described later. As a result, aggregated cargo 18 is accommodated and preserved with flexible sheet members 20 held mounted in storage station 12. When the aggregated cargo 18 with flexible sheet members 20 is mounted and stored in the storage station 12, auxiliary carriage 50 is removed from an engagement with flexible sheet members 20 in storage station 12.

Figure 4:
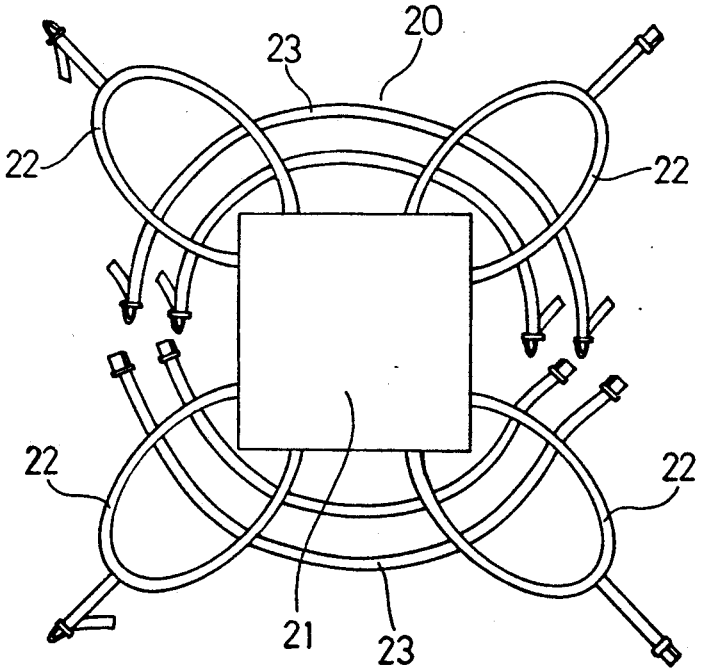
FIG. 4 is a developed view showing another embodiment of flexible sheet member.

Flexible sheet members 20, as shown in FIG. 4, may not be provided with keeping members 24 shown in FIG. 4, but it may consist of bottom plate 21, hanger strips 22 and side tightening members 23 as well.

In the storage station 12 permitting to accommodate aggregated cargo 18 with flexible sheet members 20, a traverse conveying track 30 is provided, so as to extend across a traveling path, along with which the overhead traveling crane 16 travels in the longitudinal direction of the trawler 1.

The traverse conveying track 30 enables a smooth and automatic transportation of aggregated cargo 18 from storage station 12 to the deck 13 of the trawler 1.

More particularly, on one side of storage station 12, the traverse conveying track 30 is provided such that it crosses the longitudinal direction traveling path of overhead traveling crane 16. Traverse conveying track 30 may be of any structure so long as automatic conveyance of aggregated cargo 18 with flexible sheet members 20 can be carried out. However, since storage station 12 is held at a very low temperature of approximately −30° C., the track 30 is suitably constituted by an endless chain conveyor with a plurality of links 31 coupled by pin 32. Further, as will be shown later, the track 30 has receiving members 33 at a predetermined interval thereof, to engage with opposite sides of auxiliary cargo members 50 (FIGS. 6 (*a*) and 6 (*b*)).

Figure 2:
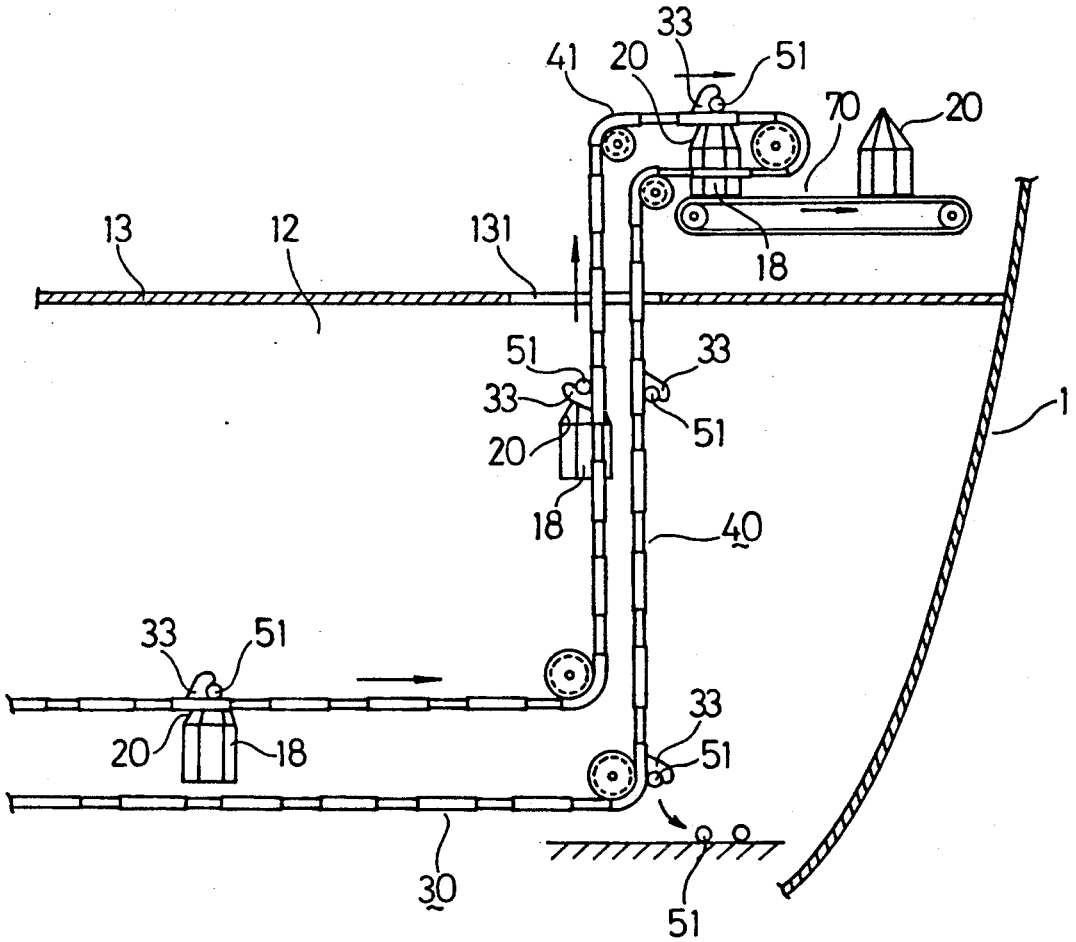
FIG. 2 is a side sectional view showing traverse and vertical conveying tracks in one embodiment of the cargo handling apparatus according to the invention.

Further, a vertical conveying track 40 is provided adjacent to the leading end, i.e., outlet, of the traverse conveying track 30. More particularly, as shown in FIG. 2, the vertical conveying track 40 has a lower end portion adjacent to the outlet portion of the traverse conveying track 30. However, in an embodiment shown in FIG. 2, both tracks 30 and 40 are merely provided adjacent to one another, but they are integrally coupled to each other. Vertical conveying track 40 has an upper end portion 41 projecting onto the deck 13, as shown in FIG. 2. The upper end portion 41 is bent to be substantially parallel to the deck 13. In this case, if traverse conveying track 30 consists of a chain conveyor as noted above, vertical conveying track 40 is constructed to be a similar endless chain conveyor. Receiving members are mounted at a predetermined interval over the entire length of the chain conveyor of the vertical conveying track 40. In the case where the leading end portion traverse conveying track 30 and the lower end portion of vertical conveying track 40 are connected to each other such that both tracks 30 and 40 are integral, as shown in FIG. 2, individual receiving members of vertical conveying track 40 are constructed such that they are common to receiving members 33 of traverse conveying track 30.

On the traverse and vertical conveying tracks 30 and 40 having the above construction, aggregated cargo 18 having flexible sheet member 20 thereon can be conveyed from the storage station 12 to the deck 13, by utilizing auxiliary carriage member 50 engaging with flexible sheet member 20.

The automatic conveying of aggregated cargo 18 from the storage station 12 onto the deck 13, using both tracks 30 and 40, can be carried out by the medium of auxiliary carriage member 50. In addition, the deck 13 sealing storage station 12 has therein a hatch 131 (see FIG. 2) with an area allowable to be passed through only by the upper end portion of vertical conveying track 40, thereby eliminating a hatch with an unnecessarily large size, i.e., a size capable of being penetrated by the cargo handling crane provided on the deck 13. Thus, storage station 12 can be substantially completely sealed, and sufficient freezing and preservation can be achieved.

Auxiliary carriage member 50, as shown in FIG. 6 (*a*), consists of rod-like member 51 and engaging member 52. In FIG. 6 (*a*), a rod-like member 51 has a circular cross section.

Figure 5A:
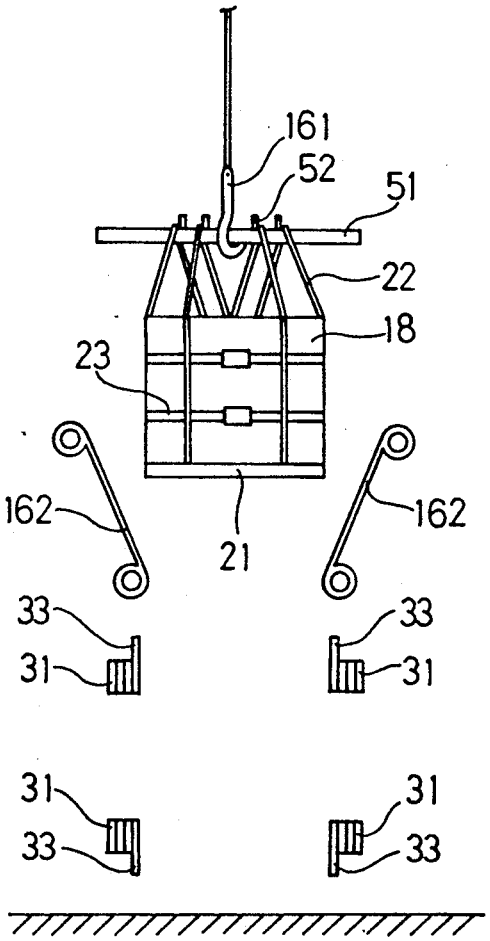
FIGS. 5(*a*) and 5(*b*) are views showing the process of transference of aggregated cargo from the overhead traveling crane to the traverse conveying track in the cargo handling apparatus shown in FIG. 2.
Figure 5B:
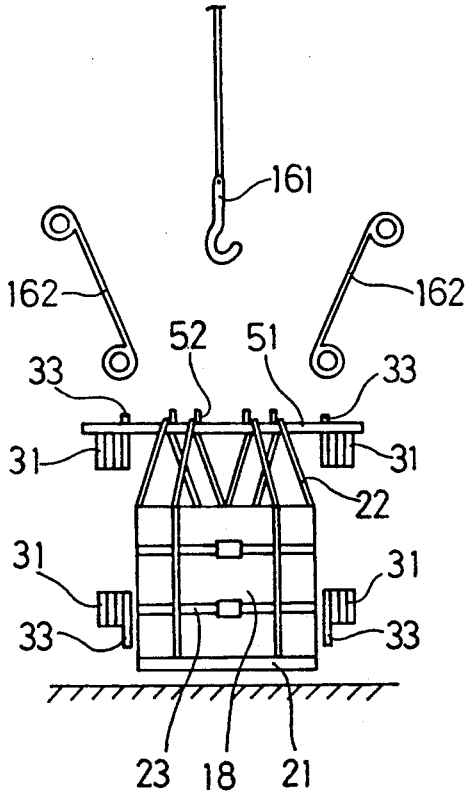

However, it is possible to use a rod-like member 51 having a rectangular cross section, as shown in FIG. 6 (*b*). Further, it is possible to use a rod-like member having a shape other than circular or rectangular shape, for instance a shape having a local arcuate section or an oval or polygonal sectional profile. As shown in FIG. 6 (*a*), engaging members 52 are provided at an interval along a line on the surface of the rod-like member 51, and a part of flexible sheet member 20, i.e., hanger strips 22 or engaging strips coupled thereto (not shown) are engaged with the engaging members 52. Further, rod-like member 51 shown in FIG. 6(*b*) has a central notched portion 53, with which hanger strips 22 of flexible sheet member 20 or engaging strips coupled thereto are engaged. Auxiliary carriage member 50 engaging with flexible sheet member 20 is hung by crane 16. Aggregated cargo 18 thus suspended by overhead traveling crane 16 is transferred onto a transfer station of the traverse conveying track 30, as shown in FIG. 5(*a*). This transfer station is usually formed at an inlet portion of the traverse conveying track 30. For this reason, a pair of guide members 162 are provided on the top of the transfer station of traverse conveying track 30, as shown in FIG. 5 (*a*). Thus, when aggregated cargo 18 suspended by hook 161 is lowered as it is guided by a pair of guide members 162, the opposite end portions of rod-like member 51 of auxiliary carriage member 50 are seated on two waiting stations 60 (see FIG. 7) to be described later. At this time, traverse conveying track 30 is being moved continuously. Therefore, rod-like member 51 waiting on waiting stations 60 is engaged with engaging portion of receiving member 33 (see FIG. 5 (*b*)), and aggregated cargo 18 is conveyed in a state suspended by auxiliary carriage member 50, with the continuous running of traverse conveying track 30.

Instead of suspending aggregated cargo 18 by hook 161 directly engaged with auxiliary carriage member 50, another strip (not shown) may be engaged with the flexible sheet member 20, and hook 161 may be engaged with this other strip to hang aggregated cargo 18.

Figure 7:
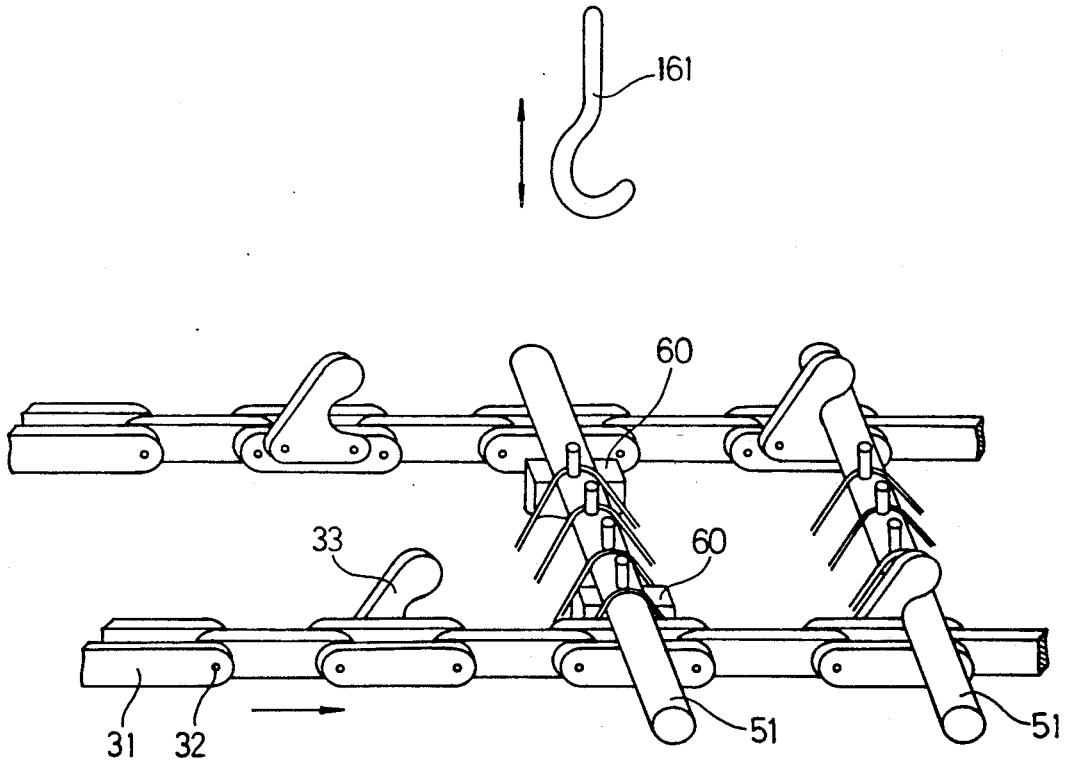
FIG. 7 is a perspective view showing a waiting station of the cargo handling apparatus according to the invention in relation to the traverse and vertical conveying tracks.

Further, for ensuring a smooth transference of aggregated cargo from hook 161 of overhead traveling crane 16 to traverse conveying track 30, the transfer station is provided with a pair of waiting stations 60, as shown in FIG. 7. More specifically, receiving members 33 are provided at a predetermined interval along the traverse conveying track 30, and run continuously at a predetermined speed in the direction of the arrow in FIG. 7. For this reason, if the transference of aggregated cargo 18 from hook 161 of overhead traveling crane 16 is not done with respect to receiving member 33 of traverse conveying track 30, the opposite end portion of rod-like member 51 of auxiliary carriage member 50 can not be engaged with the engaging portion of the opposite receiving members 33. In addition, at the time of the transference of aggregated cargo 18, one problem arises, in which hook 161 is not liable to be disengaged from the rod-like member 51 of auxiliary carriage member 50. To remove this problem in traverse conveying track 30, a transfer station, to which hook 161 of overhead traveling crane 16 descends is provided with a pair of waiting stations 60, as shown in FIG. 7. Each of waiting stations 60 may have any structure unless they can receive rod-like member 51. Usually, however, they are suitably constructed as block-like unit having a surface slightly higher than the level of the engaging portion of receiving member 33. With this construction, the rod-like member 51, when lowered in engagement with hook 161, is contacted with waiting stations 60. Instantaneously this contact generates a reaction force against the hook 161. The reaction force enables disengagement of the hook 161 from the rod-like member 51.

Further, since the rod-like member 51 without the hook 161 is carried by receiving members 33 of the traverse conveying track 30 in the above way, the hook 161 is automatically away from the rod-like member 51. The receiving member provided in the traverse or vertical conveying track 30 or 40 may have any structure so long as the rod-like member 51 is engaged with it without disengagement with it during conveying. For instance, where the rod-like member 51 has a circular sectional profile and also both tracks 30 and 40 are integral and continuous, as shown in FIGS. 2 and 7, receiving member 33 has an L-shaped form, the engaging portion of receiving member 33 has an arcuate structure, and also this L-shaped receiving member 33 is a common receiving member to the vertical conveying track 40. On the contrary, when both tracks 30 and 40 are constructed independently as shown in FIGS. 8 (*a*) and 8 (*b*), each receiving member 33 of traverse conveying track 30 is constructed to have a Y-shaped form, while each receiving member 42 of vertical track 40 is constructed to have an L-shaped form.

Figure 8A:
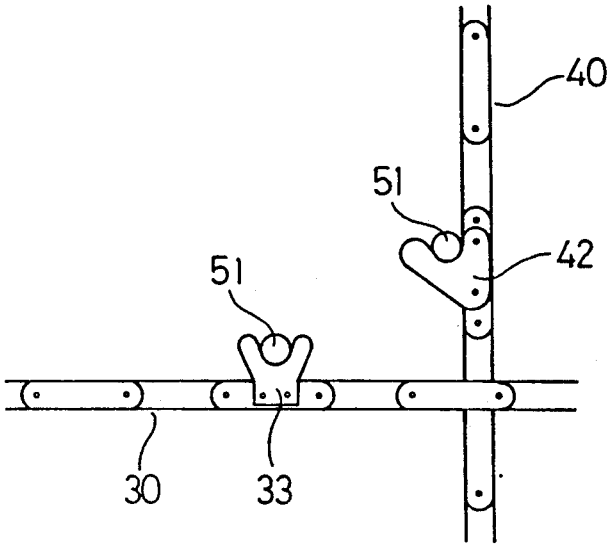
FIGS. 8(*a*) and 8(*b*) are a side view and a plan view showing the traverse and vertical conveying tracks separately.
Figure 8B:
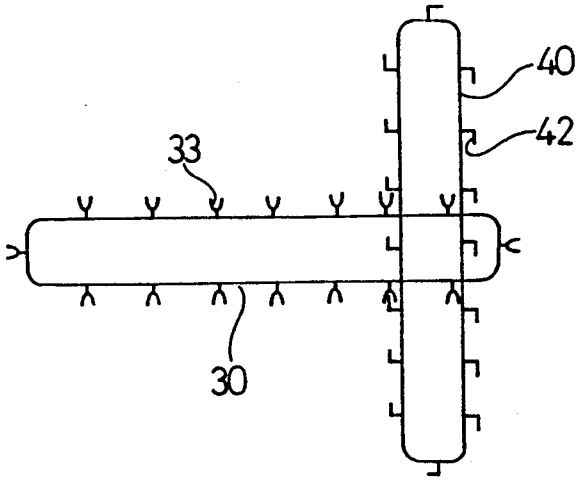

Further, instead of forming traverse and vertical tracks 30 and 40 integrally and continuously as shown in FIG. 2, they may be constructed independently as shown in FIGS. 8 (*a*) and 8 (*b*).

More specifically, a leading end portion of traverse conveying track 30 consisting of a pair of endless chains is constructed such as to receive a lower end portion of a vertical conveying track 40 consisting of a pair of chain conveyors. In addition, Y-shaped receiving members 33 are provided for the traverse conveying track 30 and L-shaped receiving members 42 are provided for the vertical conveying track 40. For this reason, when aggregated cargo 18 reaches the leading end of traverse track 30, the opposite end portions of rod-like member 51 of auxiliary carriage member 50 is transferred to receiving member 42 existing at lower end portion of the vertical conveying track 40, so that the rod-like member 51 suspending aggregated cargo 18 via flexible sheet member 20 is lifted onto the deck 13. With both the tracks 30 and 40 constructed separately in this way, the level of traverse conveying track 30 can be freely adjusted.

Further, a conveyor 70 is provided on the deck 13, so as to exist under upper end portion 41 of vertical conveying track 40, particularly under a horizontal portion thereof. When the aggregated cargo 18 reaches upper end portion 41 of vertical conveying track 40, the bottom of the aggregated cargo 18 hung by auxiliary carriage member 50 is brought into contact with the surface of conveyor 70. This contact makes a float of the aggregated cargo 18 from the vertical conveying track 40 and in sequence a disengagement of the opposite end portion of the rod-like member 51 with receiving member 42 of vertical conveying track 40. As a result, the disengaged member 51 is easily to be taken out from the flexible sheet member 20 covering the aggregated cargo 18.

Namely, a float due to the contact between the aggregated cargo 18 and the conveyor 70 makes instantaneous float of the auxiliary carriage member 50 engaged with the flexible sheet member 20. This float results in a disengagement of the auxiliary cargo member 50 with the receiving member 42 of the vertical conveying track 40.

The now-disengaged auxiliary carriage member 50 is taken out. Thereafter, the auxiliary carriage member 50 is subjected in sequence to returning into the storage station 12, by means of the vertical conveying track 40, to collecting in the storage station 12, and to re-using at late or next cargo handling.

Next, detailed explanation is as follows, in accordance with one example related to this invention.

In a processing station of the trawler during offshore fishing, Alaska pollack immediately after fishing was subjected to collecting edible portion thereof, and to processing the resultant portion by conventional technique, thereby obtaining offshore surimi. The offshore surimi was packed in 20-kg boxes or cases and then frozen. This frozen surimi was supplied as cargo units each of 20 kg one after another to a storage station adjacent to the processing station. In the storage station, 80 cases (i.e., a total weight of 1,600 kg) of cargo units supplied one after another were aggregated, and this aggregated cargo was covered with the flexible sheet member. At this time, the flexible sheet member of a synthetic resin or like material was spread, eight cases were put on the plane of the bottom member, and in this way the individual cases were stacked in ten layers, thereby forming an aggregated cargo. The hanger strips were set on the aggregated cargo, the four corners of the aggregated cargo and these hanger strips were connected by connecting strip members.

Thereafter, the aggregated cargo is stored covered with flexible sheet member in the storage station held at a temperature of approximately −30° C.

At the transference of the aggregated cargo stored in the storage station onto the deck of trawler, the auxiliary carriage member shown in FIG. 6(*a*) was utilized. Namely, the auxiliary carriage member was set with the flexible sheet covering aggregated cargo. The aggregated cargo was suspended by overhead traveling crane having its hook engaged with the auxiliary cargo member. The aggregated cargo was transferred to the traverse conveying track at the transfer station thereof. Thereafter, the aggregated cargo was automatically transported and sequently elevated by the traverse and vertical conveying tracks each having receiving members engaged with auxiliary carriage member suspending the aggregated cargo via the flexible sheet member. In this way, the aggregated cargo was automatically transported onto the deck.

After the aggregated cargo reached onto the deck, the aggregated cargo remaining covered with the flexible sheet member is transferred to a multi-purpose vessel using trawler cargo handling crane.

In this cargo handling operation, 8000 cases (i.e., 160,000 kg) cargo handling took about 20 minutes.

Setting the auxiliary carriage member with the flexible sheet member and also operating the overhead traveling crane necessitated several persons. But no operator or worker, was necessary for transporting the aggregated cargo from the storage station to the deck of the trawler.

In comparison, in the prior art case an equivalent cargo handling operation requires a period of about 30 minutes. In this case, however, about 20 operators or workers are necessary. These operators or workers are all required to work under a very low temperature condition such as −30° C. Further, when cargo handling is carried out, the inner coldness is lost considerably for the center hatch leading to the storage station is held open for 30 minutes.

What is claimed is:

1. A cargo handling apparatus for cold storage holds of fishing vessels, comprising a storage station having a ceiling underneath a deck of a vessel for storing cargo units of fish and shellfish in a frozen or cold state in the vessels and an overhead traveling crane, disposed on said ceiling of said storage station, for traveling in said storage station in the longitudinal or traverse direction of the vessel and for conveying an aggregated cargo consisting of one or more cargo units in a state wrapped or bound by a flexible sheet member in the storage station, in which said apparatus comprises:

an auxiliary carriage member detachably mounted in one part of said flexible sheet member, said auxiliary carriage member comprising means for engaging with a hook of said overhead traveling crane;

a traverse conveying track disposed in said storage station and extending across a width direction of said vessel, for conveying said aggregated cargo, said aggregated cargo being suspended from said traverse conveying track via said auxiliary carriage member;

a vertical conveying track having a lower end which is disposed beneath said deck and extends into said storage station, said vertical conveying track being adjacent to a leading end of said traverse conveying track, said vertical conveying track also having an upper end extending up to the deck of the vessel, for receiving said aggregated cargo from said traverse conveying track, said aggregated cargo being suspended from said vertical conveying track via said auxiliary carriage member, said vertical conveying track lifting up said aggregated cargo to the deck.

2. The cargo handling apparatus for cold storage holds of fishing vessels according to claim 1, wherein said flexible sheet member includes a plate-like bottom member of a flexible material, hanger strips set to the four corners of said bottom member, at least two side tightening strips each provided between adjacent hanger strips and tightening means for coupling and tightening together opposed ends of said side tightening strips.

3. The cargo handling apparatus for cold storage holds of fishing vessels according to claim 1, wherein said auxiliary carriage member includes a rod-like member having a circular, oval or polygonal sectional profile or a sectional profile having a local arcuate portion and a plurality of spaced apart engaging members provided on said rod-like member.

4. The cargo handling apparatus for cold storage holds of fishing vessels according to claim 1, wherein said auxiliary carriage member includes a rod-like member having a circular, an oval or a polygonal sectional profile, and a notch formed on a part of the surface of said rod-like member.

5. The cargo handling apparatus for cold storage holds of fishing vessels according to claim 1, wherein said traverse conveying track has a plurality of receiving members at a predetermined interval thereon.

6. The cargo handling apparatus for cold storage holds of fishing vessels according to claim 5, wherein said receiving member has an L-shaped form or Y-shaped form.

7. The cargo handling apparatus for cold storage holds of fishing vessels according to claim 1, wherein said traverse conveying track consists of an endless chain conveyor having a plurality of links coupled to one another.

8. The cargo handling apparatus for cold storage holds of fishing vessels according to claim 1, wherein said vertical conveying track has receiving members at a predetermined interval thereon.

9. The cargo handling apparatus for cold storage holds of fishing vessels according to claim 8, wherein said receiving member has an L-shaped form or Y-shaped form.

10. The cargo handling apparatus for cold storage holds of fishing vessels according to claim 1, wherein said vertical conveying track consists of an endless chain conveyor having a plurality of links coupled to one another.

11. The cargo handling apparatus for cold storage holds of fishing vessels according to claim 1, wherein said traverse and vertical conveying tracks are continuous and coupled integrally to each other.

12. A cargo handling apparatus for cold storage holds of fishing vessels comprising a storage station underneath a deck of a vessel for storing cargo units of fish and shellfish in a frozen or cold state in the vessels and an overhead traveling crane, disposed on a ceiling of said storage station, for traveling in said storage station in the longitudinal or traverse direction of the vessel and for conveying an aggregated cargo consisting of one or more cargo units in a state wrapped or bound by a flexible sheet member in the storage station, in which said apparatus comprises:

an auxiliary carriage member detachably mounted in one part of said flexible sheet member, said auxiliary carriage member comprising means for engaging with a hook of said overhead traveling crane;

a traverse conveying track, disposed in said storage station and extending in a traverse direction of said vessel, for conveying said aggregated cargo, said aggregated cargo being suspended from said traverse conveying track via said auxiliary carriage member;

a vertical conveying track having a lower end which is disposed beneath said deck and extends into said storage station, said vertical conveying track being adjacent to a leading end of said traverse conveying track, said vertical conveying track also having an upper end extending up to the deck of the vessel, for receiving said aggregated cargo from said traverse conveying track, said aggregated cargo being suspended by said vertical conveying track with said auxiliary carriage member, said vertical conveying track lifting said aggregated cargo to the deck of the vessel; and a waiting station provided below said deck and adjacent to said traverse conveying track for receiving the auxiliary carriage member from said overhead traveling crane.

* * * * *